US011555309B2

(12) United States Patent
Kinnunen

(10) Patent No.: US 11,555,309 B2
(45) Date of Patent: Jan. 17, 2023

(54) ARRANGEMENT AND METHOD

(71) Applicant: CC WIZARD OY, Hämeenlinna (FI)

(72) Inventor: Jorma Kinnunen, Hämeenlinna (FI)

(73) Assignee: CC WIZARD OY, Hämeenlinna (FI)

( * ) Notice: Subject to any disclaimer, the term of this patent is extended or adjusted under 35 U.S.C. 154(b) by 0 days.

(21) Appl. No.: 17/280,345

(22) PCT Filed: Sep. 28, 2018

(86) PCT No.: PCT/FI2018/050702
§ 371 (c)(1),
(2) Date: Mar. 26, 2021

(87) PCT Pub. No.: WO2020/065123
PCT Pub. Date: Apr. 2, 2020

(65) Prior Publication Data

US 2022/0034091 A1 Feb. 3, 2022

(51) Int. Cl.
*E04C 2/38* (2006.01)
*E04B 1/61* (2006.01)
(Continued)

(52) U.S. Cl.
CPC ..... *E04C 2/384* (2013.01); *E04B 1/14* (2013.01); *E04B 1/617* (2013.01); *E04B 1/6116* (2013.01);
(Continued)

(58) Field of Classification Search
CPC ..... E04B 1/14; E04B 1/6116; E04B 1/617; E04B 2/58; E04B 2103/04;
(Continued)

(56) References Cited

U.S. PATENT DOCUMENTS 2,962,133 A * 11/1960 Jerome ..... F16B 5/0072 52/471
3,282,613 A 11/1966 Axelsonn
(Continued)

FOREIGN PATENT DOCUMENTS

CA 3058561 A1 * 10/2018 ..... E04B 1/14
CN 205742562 11/2016
(Continued)

OTHER PUBLICATIONS

First Office Action and Search Report for Chinese Application No. 201880032807.X, 7 pgs., dated Feb. 8, 2022.
(Continued)

*Primary Examiner* — Jessie T Fonseca
(74) *Attorney, Agent, or Firm* — Alston & Bird LLP

(57) ABSTRACT

A building system and a method for constructing a building, the system (100) comprising plurality of prefabricated elements (I), the element (1) comprising: a self-supporting insulation panel (2) comprising a rigid insulation material, —a metal frame (3), comprising a pair of sub-frames. The length of the sub-frame (7*a*, 7*b*) has a cross-section comprising an attaching arm (10) extending along the corresponding edge surface (6*a*, 6*b*), and an intruding section (11) arranged in the attaching arm (10), the intruding section (II) intruding into the insulation element (5). A box-type structure (12) is arranged distally from the intruding section (11) and comprising a closed or partly open construction. The building system further comprises a connecting element (4), having a cross-section basically a shape of a U-profile. The connecting element (4) is arranged on sub-frames (7*a*, 7*b*) of two adjacent elements (1).

18 Claims, 6 Drawing Sheets

(51) Int. Cl.

| | |
|---|---|
| ***E04B 2/58*** | (2006.01) |
| ***E04C 2/284*** | (2006.01) |
| ***E04B 2/00*** | (2006.01) |
| ***E04D 3/366*** | (2006.01) |
| ***E04B 1/14*** | (2006.01) |

(52) U.S. Cl.
CPC ..... *E04B 2/58* (2013.01); *E04C 2/284* (2013.01); *E04C 2/46* (2013.01); *E04D 3/366* (2013.01); *E04B 2103/04* (2013.01); *E04B 2103/06* (2013.01)

(58) Field of Classification Search
CPC .. E04B 2103/06; E04B 2001/386; E04C 2/46; E04C 2/284; E04C 2/384; E04D 3/366
See application file for complete search history.

(56) References Cited

U.S. PATENT DOCUMENTS

| | | | | | |
|---|---|---|---|---|---|
| 3,359,022 | A * | 12/1967 | Russell | E04B 1/6116 | 52/468 |
| 3,594,028 | A * | 7/1971 | Scott | F16B 5/0064 | 52/471 |
| 4,435,935 | A * | 3/1984 | Larrea | E04F 13/0889 | 52/471 |
| 4,633,634 | A | 1/1987 | Nemmer | | |
| 5,031,375 | A * | 7/1991 | Martinez | E04D 3/366 | 52/584.1 |
| 5,078,530 | A * | 1/1992 | Kim | F16B 5/004 | 52/75 |
| 6,164,024 | A * | 12/2000 | Konstantin | E04D 3/08 | 52/582.1 |
| 6,363,647 | B2 | 4/2002 | Carver | | |
| 6,363,674 | B1 | 4/2002 | Carver | | |
| 7,788,869 | B2 * | 9/2010 | Voegele, Jr. | E04D 3/366 | 52/582.1 |
| 8,584,424 | B2 * | 11/2013 | Smith | E04D 3/366 | 52/582.1 |
| 9,181,692 | B1 * | 11/2015 | Callaway | E04F 19/024 | |
| 9,312,411 | B2 * | 4/2016 | Laurin | E04D 3/28 | |
| 9,562,356 | B2 * | 2/2017 | Israeli | E04D 3/362 | |
| 9,926,699 | B2 * | 3/2018 | Ben David | E04B 1/68 | |
| 11,053,680 | B1 * | 7/2021 | McGee | E04B 1/14 | |
| 2005/0204699 | A1 * | 9/2005 | Rue | E04C 2/384 | 52/794.1 |
| 2009/0049771 | A1 * | 2/2009 | Konstantin | E04C 2/543 | 52/204.63 |
| 2009/0272056 | A1 * | 11/2009 | Koupal | E04B 1/6162 | 52/309.4 |
| 2011/0036039 | A1 * | 2/2011 | Wang | E04D 3/366 | 52/582.2 |

FOREIGN PATENT DOCUMENTS

| | | | | |
|---|---|---|---|---|
| CN | 106988435 | A | 7/2017 | |
| EA | 000420 | B1 | 6/1999 | |
| EP | 0624695 | A2 | 11/1994 | |
| EP | 3868969 | A1 * | 8/2021 | |
| GB | 2297824 | A * | 8/1996 | E04D 3/352 |
| RU | 2298619 | C2 | 5/2007 | |
| RU | 2485259 | C2 | 6/2013 | |

OTHER PUBLICATIONS

International Search Report and Written Opinion for PCT/FI2018/050702 (ISA/EP) dated Jun. 14, 2019 (2 pages).

* cited by examiner

ARRANGEMENT AND METHOD

CROSS-REFERENCE TO RELATED APPLICATIONS

The present application is a national phase entry of International Application No. PCT/FI2018/050702, filed Sep. 28, 2018, which is incorporated herein by reference in its entirety.

BACKGROUND

The invention relates to a building system for constructing a building.

The invention further relates to a method for constructing a building.

It is known to build buildings based on a metal frame construction. The metal frame may give advantages in greater strength, fire resistance and architectural design flexibility, for instance. A thermal insulation layer is attached to the metal frame either outside of the metal frame or between metal profiles that form the metal frame.

A problem with the metal frame constructions is that they usually are based on idea just to replace a wooden frame construction by metal components. The building cost is relatively high because of the costly materials and the skilled crew and special equipment are needed to assemble the building. Therefore, the construction technique is generally considered unsuitable for single family residence building.

BRIEF DESCRIPTION

Viewed from a first aspect, there can be provided a building system for constructing a building, the system comprising: plurality of prefabricated elements, the element comprising: a self-supporting insulation panel comprising a rigid insulation material and having two straight and parallel edge surfaces, and an outer and inner surfaces, a metal frame, comprising a pair of sub-frames, a first subframe attached to a first edge surface and a second subframe attached to a second edge surface of the insulation panel, the sub-frame extending along the length of the insulation panel, the length of the sub-frame having a cross-section comprising an attaching arm extending along the corresponding edge surface, and an intruding section arranged in the attaching arm and in an angle respect to that, the intruding section intruding into the insulation element, and a box-type structure arranged distally from the intruding section and comprising walls and corners constituting a closed or partly open construction, the box-like structure extending from the attaching arm and being arranged on the outer surface or on the inner surface of the insulation panel, the building system further comprising a connecting element, being at least essentially as long as the sub-frame and having a cross-section comprising two arms and a connecting section connecting said two arms, the cross-section having basically a shape of an U-profile, the connecting element, in use, being arranged on sub-frames of two adjacent elements, said arms being situated on opposite side of the two sub-frames and keeping together said sub-frames of adjacent elements.

Thereby a building system easy to assemble may be achieved.

Viewed from a further aspect, there can be provided a method for constructing a building, the method comprising: connecting two of prefabricated elements described above by contacting their opposite edge surfaces to each other, attaching the sub-frames of said prefabricated elements to each other, arranging the connecting element according to any of the preceding claims on said sub-frames, and attacking said connecting element to said sub-frames.

Thereby a method that produces a supporting structure and insulated structure quickly and easily may be achieved.

The arrangement and the method are characterised by what is stated in the characterising parts of the independent claims. Some other embodiments are characterised by what is stated in the other claims. Inventive embodiments are also disclosed in the specification and drawings of this patent application. The inventive content of the patent application may also be defined in other ways than defined in the following claims. The inventive content may also be formed of several separate inventions, especially if the invention is examined in the light of expressed or implicit sub-tasks or in view of obtained benefits or benefit groups. Some of the definitions contained in the following claims may then be unnecessary in view of the separate inventive ideas. Features of the different embodiments of the invention may, within the scope of the basic inventive idea, be applied to other embodiments.

BRIEF DESCRIPTION OF FIGURES

Some embodiments illustrating the present disclosure are described in more detail in the attached drawings, in which.

In the figures, some embodiments are shown simplified for the sake of clarity. Similar parts are marked with the same reference numbers in the figures.

DETAILED DESCRIPTION

Figure 1:
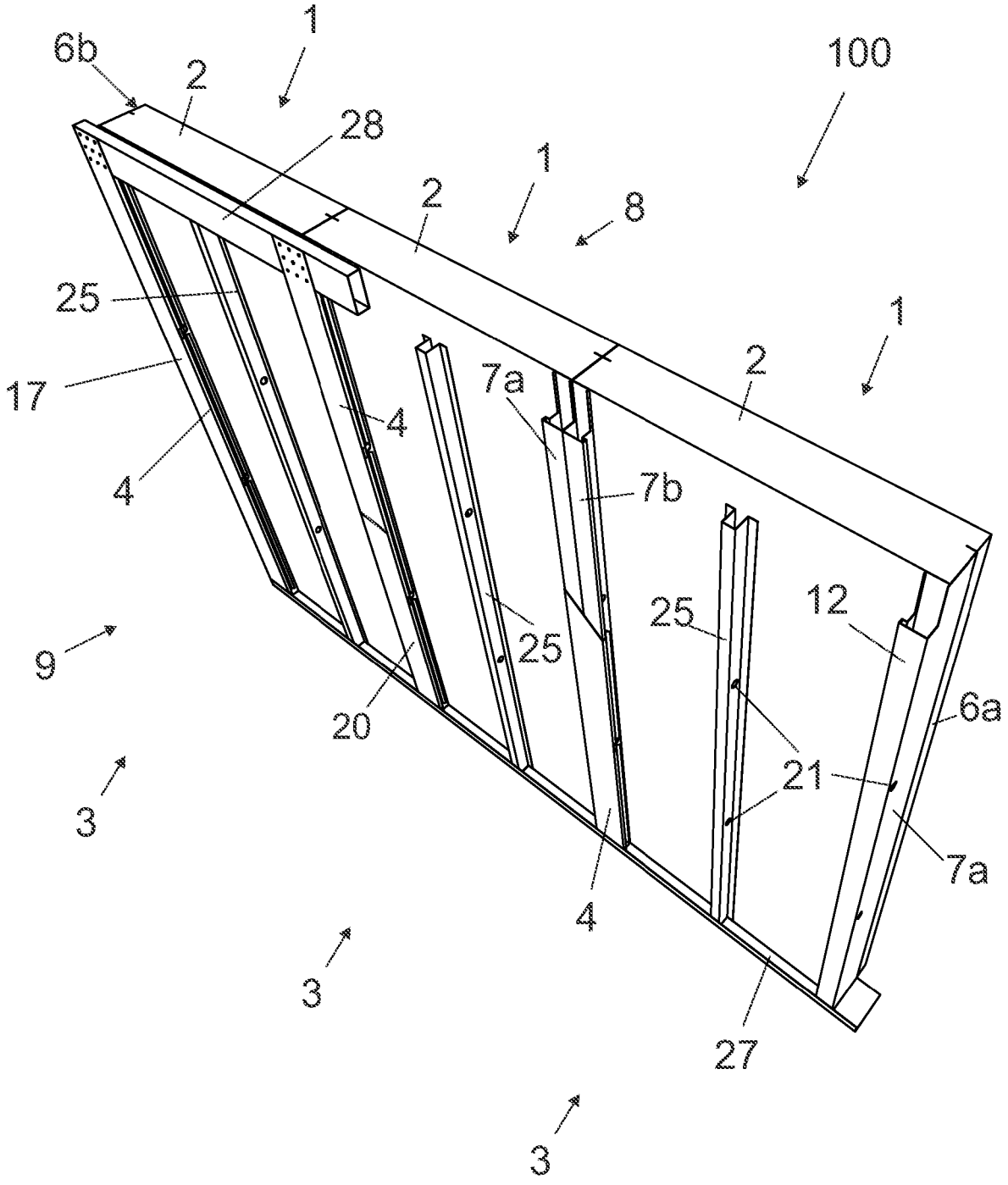
FIG. 1 is a schematic view of detail of a building system for constructing a building.

FIG. 1 is a schematic view of detail of a building system for constructing a building. The system 100 comprises plurality of prefabricated elements 1 that are connected together for creating a wall, a floor, a roof or a ceiling of a building. Thus, in an embodiment, the prefabricated element 1 is a wall element. In another embodiment, the prefabricated element 1 is a floor element. In a third embodiment, the prefabricated element 1 is a ceiling element.

The element 1 comprises a self-supporting insulation panel 2 comprising a rigid thermal insulation material and having two straight and parallel edge surfaces 6*a*, 6*b*, and an outer and inner surfaces 8, 9.

According to an aspect, the material of the insulation panel 2 comprises at least one of the following materials: polyisocyanurate (PIR), polyurethane (PUR) and extruded polystyrene (XPS), or another rigid insulation material. In an embodiment, the insulation panel 2 has a homogenous structure and material, e.g. rigid foam insulation material, from its outer surface to its inner surface.

In an embodiment, the insulation panel 2 has a shape of rectangle. The dimensions of the element 1 may be e.g. 1200 mm (width)×3000 mm (height). According to an idea, the width of the element is selected in range of 300 mm to 2400 mm, and the height 600 mm to 15000 mm. In an embodiment, the thickness of the insulation panel is selected in range of 100 mm to 300 mm, and the thickness of the insulation panel is uniform from its first edge surface to another edge surface.

The element 1 further comprises a metal frame 3 that includes a pair of sub-frames: a first sub-frame 7*a* attached to a first edge surface 6*a* and a second sub-frame 7*b* attached to a second edge surface 6*b* of the insulation panel 2. In an embodiment, the sub-frame 7*a*, 7*b* extends along the entire length of the insulation panel 2, i.e. the length of the sub-frame is 100% of length of the insulation panel. However, said length may be essentially more; in an embodiment the length of the insulation panel 2 is 80-99% of the length of the sub-frame 7*a*, 7*b*.

In still another embodiment, the sub-frame 7*a*, 7*b* is essentially longer than the insulation panel 2, such that the metal frame 3 makes it possible to attach two or more insulation panels 2 one on the other.

In an embodiment, the insulation panel 2 is essentially longer than the sub-frame 7*a*, 7*b*, so that an upper edge of the panel extends above upper ends of the sub-frames. The extension may be e.g. 100 mm-500 mm, or 20% of the length of the insulation panel. In an embodiment, the extension has same thickness as the rest of the insulation panel. In another embodiment, the extension is thinner, e.g. 50 mm-100 mm. An advantage of the extension is that it insulates a roof space above the room, and may also be useful to limit the roof space when applying loose wool, such as loose mineral wool, therein.

In an embodiment, the sub-frame 7*a*, 7*b* is of bended sheet metal, thickness of which is in range of 0.5-3 mm. Also the auxiliary profile 25 may be of similar material. The material may comprise e.g. steel. In an embodiment, the steel is a strain hardening steel, such as DP780/980. An advantage is that the element stands well against high loads, and loads exceeding yield strength of the material are adsorbed in deformations of the structure. However, the steel may also be selected from group of conventional structural steels.

In an embodiment, the sub-frame 7*a*, 7*b* is attached to the insulation panel 2 by a glue layer 22. The glue layer may be arranged between an attaching arm 10 of the sub-frame and the corresponding edge surface 6*a*, 6*b*, and/or between a box-type structure 12 of the sub-frame and the corresponding surface of the insulation panel. Also the intruding section 11 may be glued to the insulation panel 2.

In an embodiment, the metal frame 3 or, at least the surfaces thereof to be glued, have a special surface that enhances adhesion of the glue. Preferably, the strength of the glued joint is defined by cohesion strength of the glue, not adhesion of the glue to the surface. The special surface may be produced by a passivating zinc plating, a ground coating, an anti-fingerprint treatment, or an activation process such as a corona or a flame treatment.

The sub-frames 7*a*, 7*b* are attached to the insulation panel 2 in the manufacturing phase of the element 1. The glue may be e.g. polyurethane (PUR) or silyl modified polymer (SMP). An advantage of the SMP is that in the gluing process there is not released any potentially harmful emissions.

According to an aspect, there is layer of at least 20 mm, preferably at least 70 mm, of insulation panel between the outer surface 8 and the attaching arm 10. An advantage is that the good insulation properties of the wall/ceiling/floor may be ensured.

The building system 100 shown in FIG. 1 further comprises a connecting element 4 that is at least essentially as long as the sub-frame 7*a*, 7*b*. In another embodiment, the connecting element 4 is essentially shorter than the subframe 7*a*, 7*b*, e.g. 80% of the length of the sub-frame.

When connecting two elements 1, the connecting element 4 is arranged on sub-frames 7*a*, 7*b* of two adjacent elements 1. The connecting element 4 keeps together said sub-frames 7*a*, 7*b* of adjacent elements 1.

In an embodiment, the metal frame 3 comprises at least one auxiliary profile 25 is attached to the prefabricated element 1 between two sub-frames 7*a*, 7*b*. The auxiliary profile 25 may bear load and give support for cladding or facing panels attached to the building system 100. The auxiliary profile may be attached to the element 1 in manufacturing of the element 1, or in a construction site of the building.

FIGS. 2*a*-2*h* are schematic top views of embodiments of sub-frames of the arrangement.

The cross-section (transverse to the length of thereof) of the sub-frame 7*a*, 7*b* comprises an attaching arm 10 extending along the corresponding edge surface 6*a*, 6*b*, and an intruding section 11 that is arranged in the attaching arm 10 in an angle, preferably in right angle, respect to the attaching arm 10. The intruding section 11 intrudes into the insulation element 2, thus attaching the sub-frame to the insulation element.

The cross-section of the sub-frame 7*a*, 7*b* further comprises a box-type structure 12 arranged distally from the intruding section 11. In an embodiment, the length of the box-type structure 12 is somewhat shorter than the length of the sub-frame 7*a*, 7*b*. This is especially the case in those embodiments where the box-type structures 12 are arranged to carry a transversal upper frame member 28, shown in FIG. 1, the upper surface of which is to be adapted to the same level with the upper end of the sub-frames.

The box-type structures 12 carry largely vertical loads exerting to the building system 100.

In an embodiment, the essentially whole of the length of the sub frame 7*a*, 7*b* have a cross-section comprising the attaching arm 10, the intruding section 11, and the box-type structure 12. In another embodiment, some section(s) of length of the sub frame 7*a*, 7*b* is/are exclusive of at least one of the attaching arm 10 and the intruding section 11.

The box-type structure 12 comprises walls 13 and corners 14 constituting a closed or partly open construction. The box-like structure 12 extends from the attaching arm 10 and is arranged on the outer surface 8 or on the inner surface 9 of the insulation panel 2.

Figure 2A:
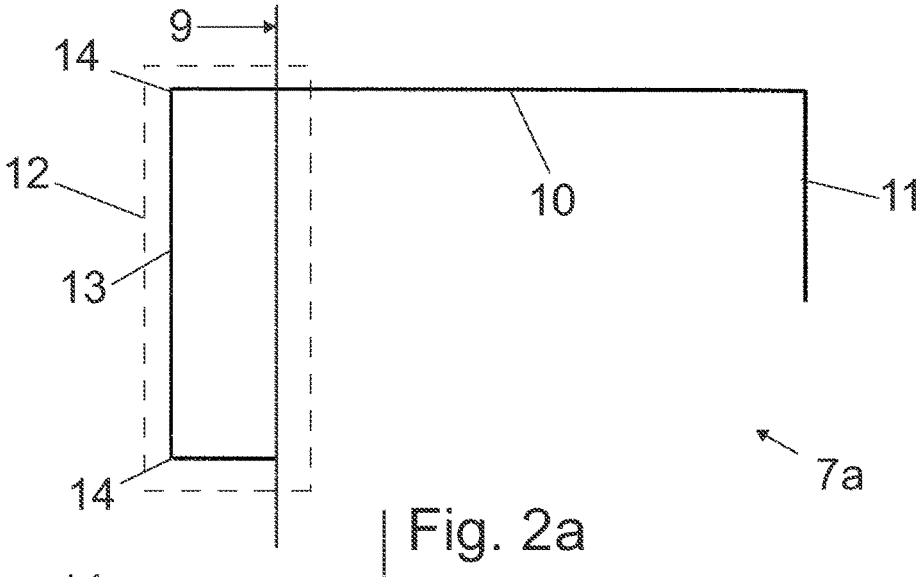
FIGS. 2*a*-2*h* are schematic top views of embodiments of sub-frames of the arrangement.
Figure 2B:
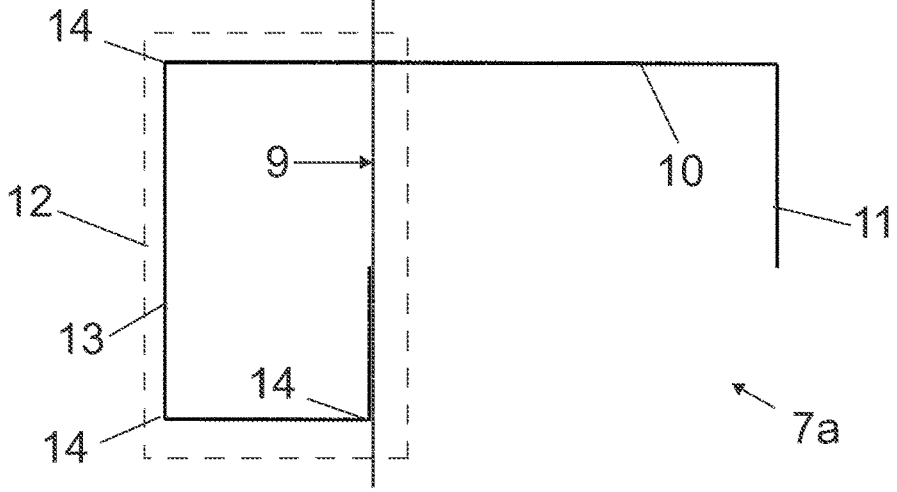
Figure 2C:
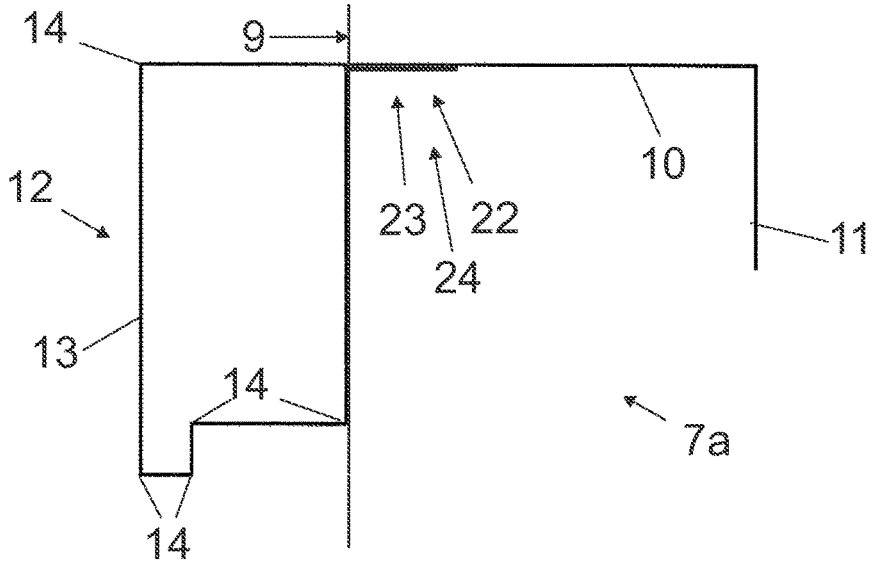
Figure 2D:
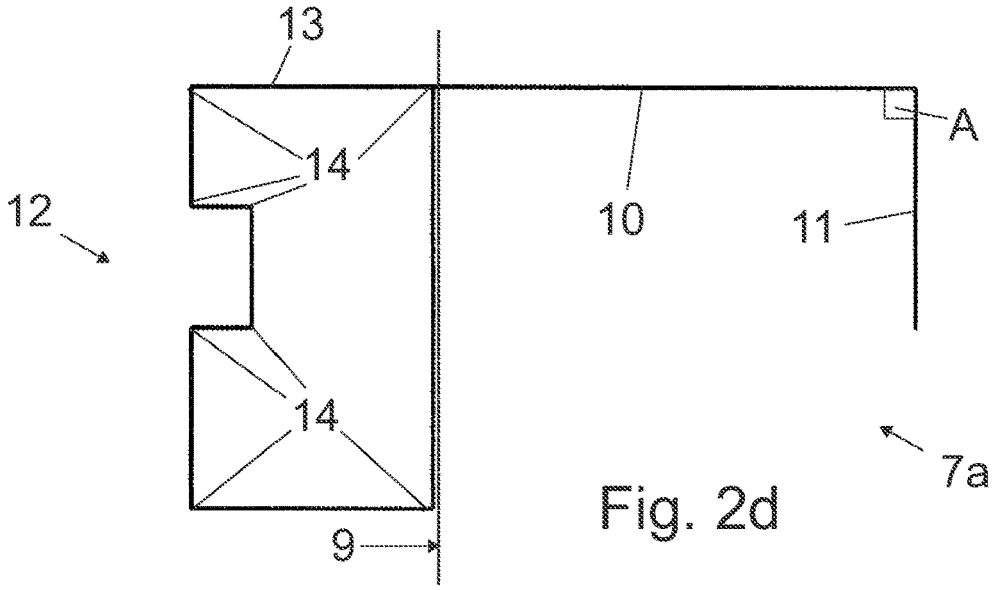
Figure 2E:
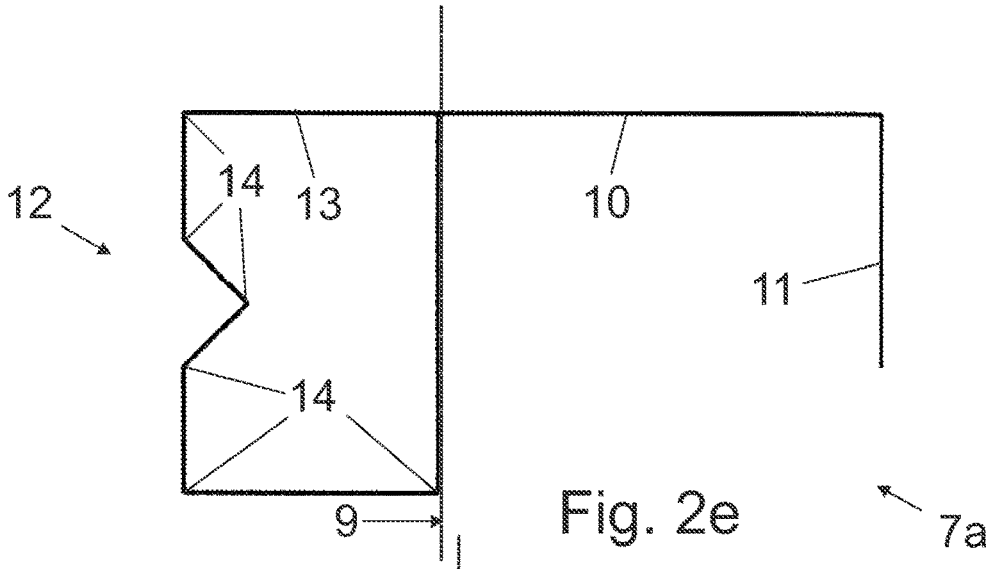
Figure 2F:
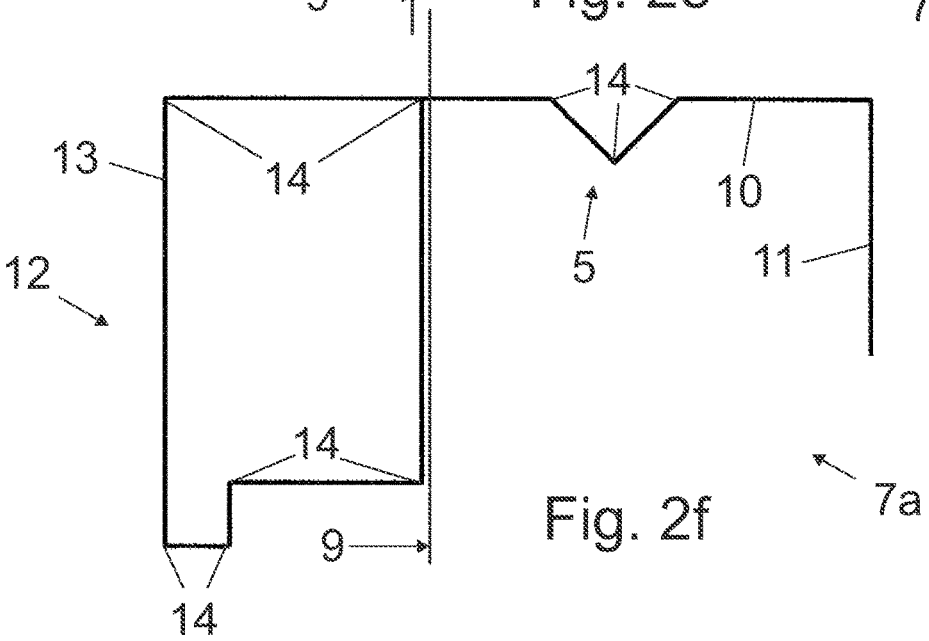
Figure 2G:
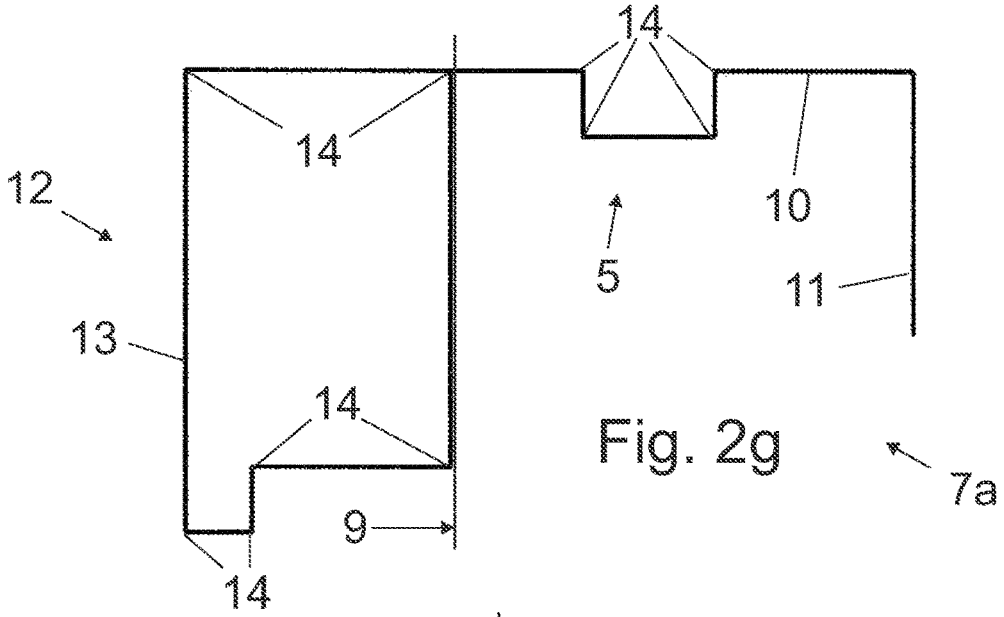
Figure 2H:
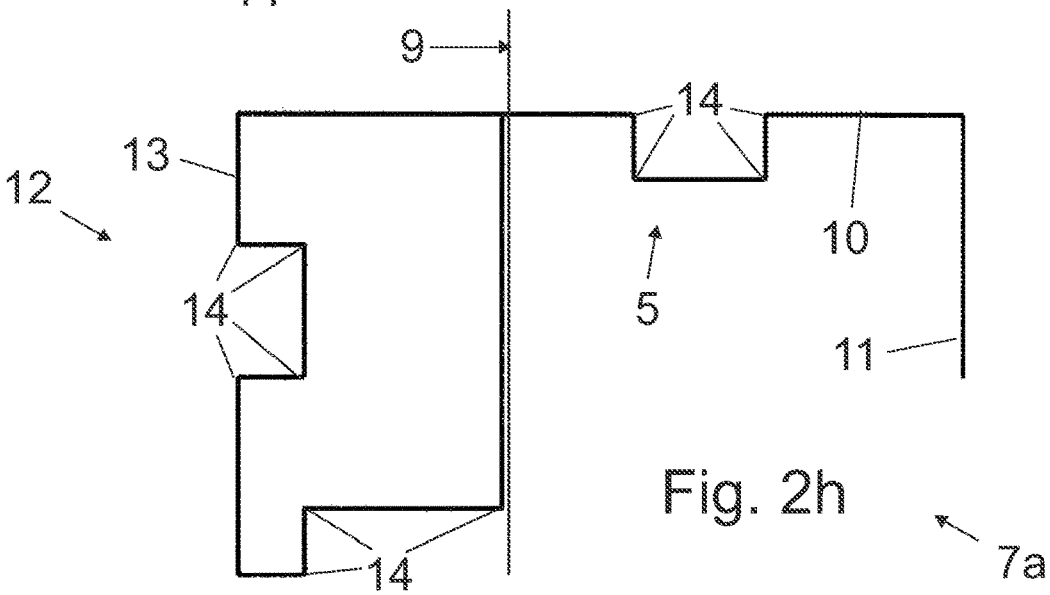
Figure 3A:
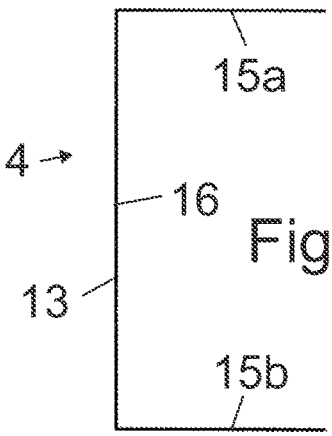
FIGS. 3*a*-3*g* are schematic top views of embodiments of connecting elements of the arrangement.
Figure 3B:
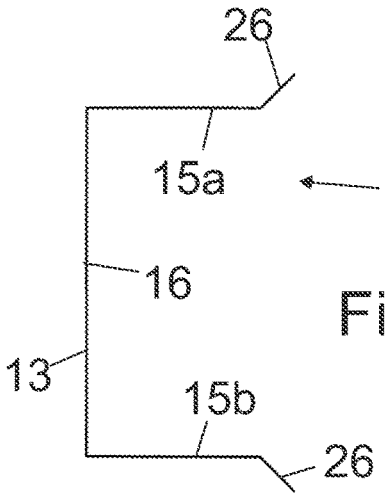
Figure 3C:
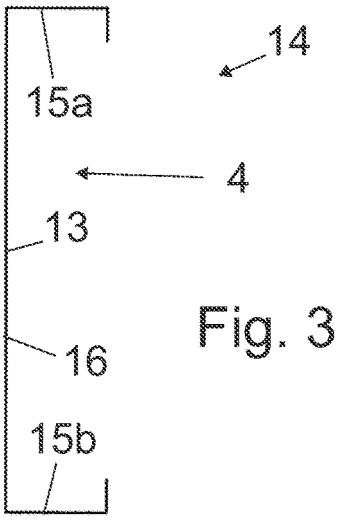
Figure 3D:
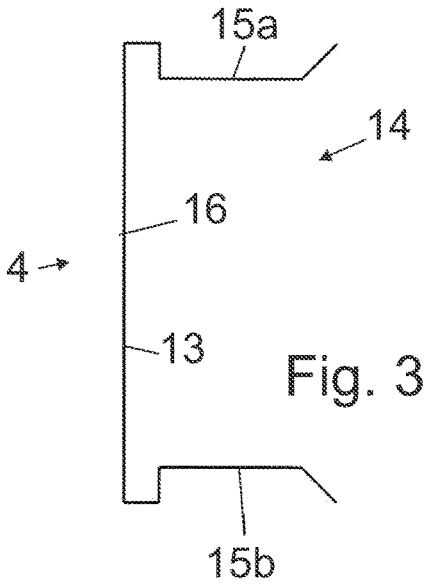
Figure 3E:
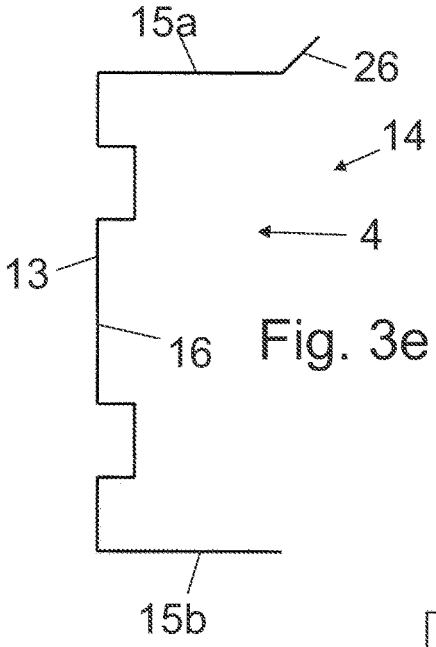
Figure 3F:
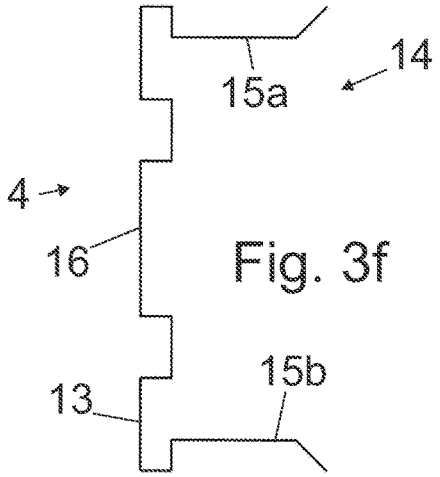
Figure 3G:
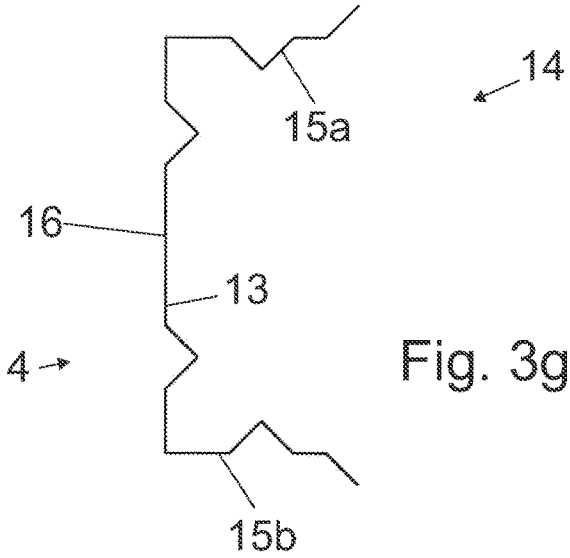

In an embodiment, the cross-section of the box-type structure 12 is an open structure. Some embodiments are shown in FIGS. 2*a* and 2*b*. An advantage is that the structure is easy and simple to manufacture.

In another embodiment, the cross-section of the box-type structure 12 is a closed structure. Some embodiments are shown in FIGS. 2*c*-2*h*. An advantage is that the structure may carry high loads.

In an embodiment of the closed structure, the box-type structure 12 is closed by a glue layer 22, a welded joint 23 and/or a fixing element 24. The fixing element 24 may be e.g. a screw, a rivet, etc.

In an embodiment, the box-type structure 12 comprises at least three corners 14 when seeing from the end thereof. In an embodiment, the box-type structure 12 comprises at least four corners 14 when seeing from the end thereof. In an embodiment, the box-type structure 12 comprises at least five corners 14 when seeing from the end thereof. An advantage is that the more corners, the higher is the stiffness of the structure.

In an embodiment, the attaching arm 10 is straight when seeing from the end thereof. In another embodiment, the attaching arm 10 comprises at least one bend 5 when seeing from the end thereof, and the edge surface 6*a*, 6*b* of the insulation panel respective shapes adapted to the shape of the attaching arm 10, and the bend 5 may comprise e.g. at least three corners. In another embodiment, the attaching arm 10 comprises corrugations. Advantages of these embodiments are that the stiffness is increased and more surface for gluing created.

The corners 14 and bends 5 stiffens the structure of the building system 100. Additionally, they may form tongue-and-groove-type attaching means in connections of two elements 1.

In an embodiment, the intruding section 11 is arranged at the distal end of the attaching arm 10. An advantage is that as the distance to the box-type structure 12 is maximized, and the stiffness of the element 1 may be optimized.

In an embodiment, the intruding section 11 is arranged in angle (A) of 90° in the attaching arm 10. An advantage is that the intruding section 11 is simple to push in the material of the insulation panel, and also strength of the element may be increased.

In an embodiment, the intruding section 11 comprises corrugations. An advantage is that the stiffness is increased and more surface for gluing created.

FIGS. 3*a*-3*g* are schematic top views of embodiments of connecting elements of the arrangement.

The connecting element 4 is at least essentially as long as the sub-frame 7*a*, 7*b*. In an embodiment, the length of the connecting element 4 is at least 80% of the length of the sub-frame 7*a*, 7*b*. The connecting element 4 has a cross-section comprising two arms 15*a*, 15*b* and a connecting section 16 connecting said two arms, the cross-section having basically a shape of a U-profile. The connecting element 4 keeps together said sub-frames 7*a*, 7*b* of adjacent elements 1.

The width of the connecting element 4 is dimensioned such that it may be attached on two adjacent sub-frames 7*a*, 7*b*. In an embodiment, said width is in range of 150-350 mm.

The depth of the connecting element 4 is dimensioned such that the arms 15*a*, 15*b* admit of a proper attachment of the sub-frames 7*a*, 7*b*. In an embodiment, the depth is in range of 30-150 mm.

According to an aspect of the invention, the connecting element 4 consists of one connecting-component 17, shown in FIG. 1, the length of which is at least essentially equal to the height of sub-frame 7*a*, 7*b*. An advantage is that a very sturdy combination of the sub-frames and the connecting element may be achieved.

According to another aspect of the invention, the connecting element 4 consists of plurality of connecting-components 17 that, in use, are arranged successively on the sub-frames 7*a*, 7*b* of the two adjacent elements 1. An advantage is that handling of the shorter connecting-components may be easier.

In an embodiment, there are one or more second connecting elements 20 that, in use, are arranged on the connecting element(s) 4, thus creating a multi-layered structure of connecting elements. An advantage is that the structure may be tailored easily to the requirements of the building.

In an embodiment, the sub-frame 7*a*, 7*b* and the connecting element 4, and the second connecting elements 20, if any, comprise openings 21, shown in FIG. 1, that constitute, in use, a cross-wise passage there through. An advantage is that any cables, pipes, ducts for functions needed in the building may be arranged easily in the building system.

In an embodiment, the connecting element 4 comprises a sloping 26 arranged at the free end of at least one of the arm 15*a*, 15*b*. An advantage is that the mounting of the connecting element may be facilitated.

According to an aspect, the connecting element 4 creates with the sub-frames 7*a*, 7*b* a sandwich structure that prevents efficiently twisting and buckling typical for metallic profiles.

Figure 4:
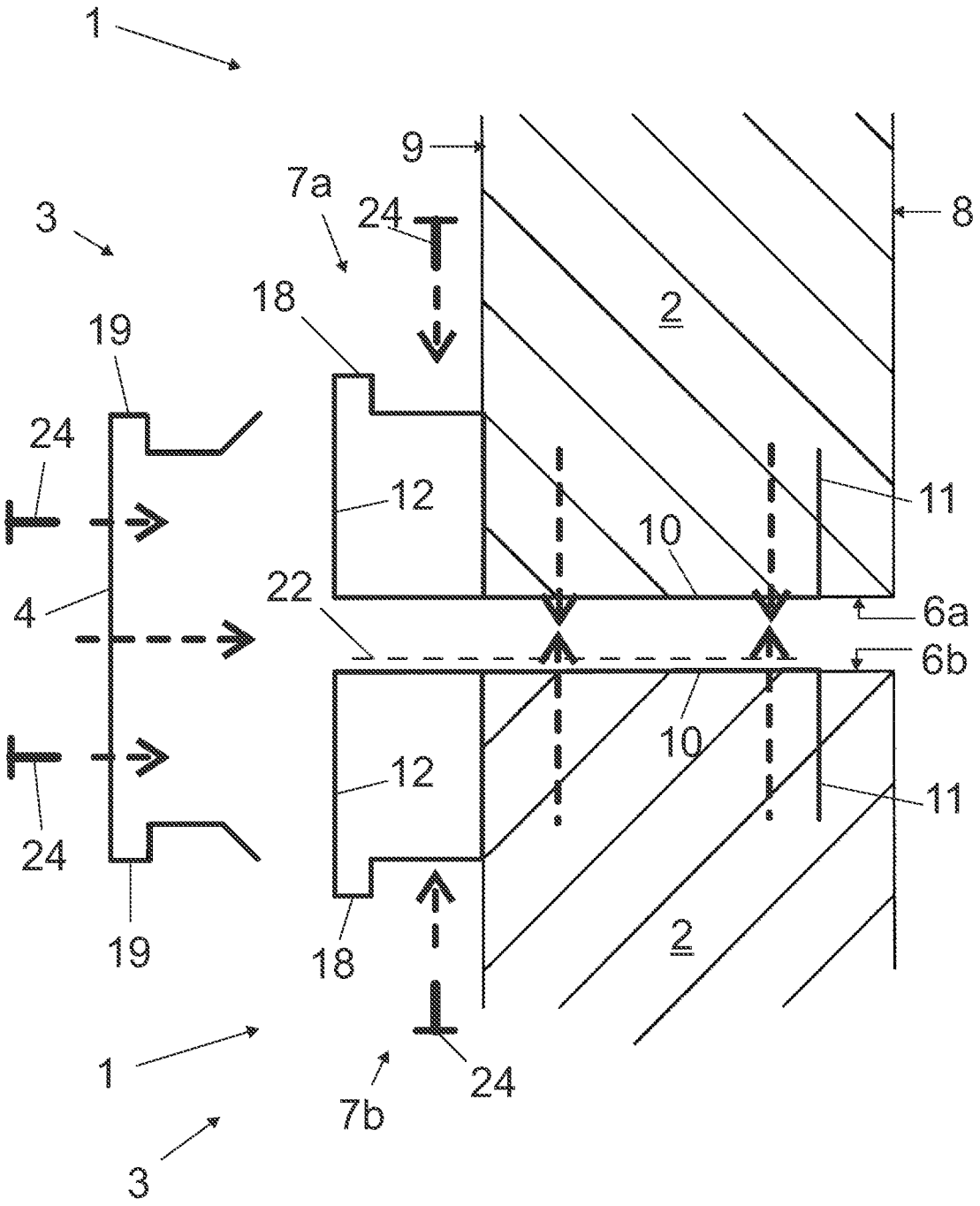
FIG. 4 is a schematic top view of an assembly method step of the arrangement.

FIG. 4 is a schematic top view of an assembly method step of the arrangement.

In the method for constructing a building, there are connected plurality of prefabricated elements 1 described in this description and created thus a demanded wall, floor, roof or ceiling of the building.

According to an aspect, when building a wall, the building system 100 comprises a transversal bottom element 27 shown in FIG. 1, on which the prefabricated elements 1 are erected. In an embodiment, the bottom element is a steel L-profile. The bottom element is preferably dimensioned such that it does not extend to the plane of the outer surface 8 of the insulation panel 2. Thus, the insulation properties of the element 1 may be maintained.

The building system 100 may also comprise a transversal upper frame member 28 arranged on top of the box-type structure 12, and in some cases, also on the attaching arm 10 and the intruding section 11. The upper frame member 28 may be e.g. steel L-profile, and dimensioned according to the same principles as described above in connection with the bottom element.

In the method two prefabricated elements 1 are connected by contacting their opposite edge surfaces 6*a*, 6*b* to each other. Then, the sub-frames 7*a*, 7*b* of said prefabricated elements 1 are attaching to each other. In an embodiment, the sub-frames 7*a*, 7*b* are attached to each other by a glue layer 22. An advantage is that the structure is even more stiff and strong.

Glue used in the glue layer 22 may be e.g. silyl modified polymer (SMP).

The glue layer 22 may also be arranged in a flap element, such as a tape, on one or both surfaces thereof. The flap element may have a soft and/or elastic base layer. In an embodiment, the flap element covers all the contacting surfaces between the sub-frames 7*a*, 7*b*. The contacting surfaces between the elements 1 not having the flap element may be provided with a foam layer that is fed from outer surface 8 side of the system.

The glue layer 22 may be arranged on all contacting surfaces where the sub-frames 7*a*, 7*b* meet each other. In another embodiment, there are selected sub-areas that are covered by the glue layer 22. Also fixing elements 24, such as screws, may be used alone or together with glue for attaching the sub-frames 7*a*, 7*b* to each other.

Following connection of the sub-frames 7*a*, 7*b*, or following their attaching, the connecting element 4 is arranged on said sub-frames 7*a*, 7*b*, and attached thereto.

In an embodiment, the connecting element 4 is attached to the sub-frames 7*a*, 7*b* by a glue layer. Also here the glue may comprise e.g. silyl modified polymer (SMP). Also fixing elements, such as screws, may be used here, alone or together with glue.

The stiff insulation panels 2 support and prevent deformations of the sub-frames 7*a*, 7*b*, and thus the prefabricated elements 1 stands well even excess loads In an embodiment, the cross-section of the box-type structure 12 comprises a first projecting section 18 that extends sideways in direction of the surface 9, 10 of the insulation panel and arranged at a distance from said surfaces. Furthermore, the first projecting section 18 is arranged on surface of the box-type structure 12 facing away from the edge surface 6*a*, 6*b* wherefrom the attaching arm 10 is extending. Similarly, the connecting element 4 comprises second projecting sections 19 that are arranged to fit in the shape first projecting sections 18 of subframes 7*a*, 7*b*. Co-operation of the first and second projecting sections 18, 19 creates a shape-based locking system between said two sub-frames 7*a*, 7*b* and the connecting element 4. An advantage is that the correctness of the fitting between the sub-frames and the connecting element may be easily detected.

The invention is not limited solely to the embodiments described above, but instead many variations are possible within the scope of the inventive concept defined by the claims below. Within the scope of the inventive concept the attributes of different embodiments and applications can be used in conjunction with or replace the attributes of another embodiment or application.

The drawings and the related description are only intended to illustrate the idea of the invention. The invention may vary in detail within the scope of the inventive idea defined in the following claims.

REFERENCE SYMBOLS

1 prefabricated element
2 insulation panel
3 metal frame
4 connecting element
5 bend
6*a, b* edge surface
7*a, b* sub-frame
8 outer surface
9 inner surface
10 attaching arm
11 intruding section
12 box-type structure
13 wall
14 corner
15*a, b* arm of connecting element
16 connecting section
17 connecting-component
18 first projecting section
19 second projecting section
20 second connecting element
21 opening
22 glue layer
23 welded joint
24 fixing element
25 auxiliary profile
26 sloping
27 bottom element
28 upper frame member
100 building system
A angle between attaching arm and intruding section

The invention claimed is:

1. An arrangement for constructing a building, the arrangement comprising:

a plurality of prefabricated elements, each element comprising:

a self-supporting insulation panel comprising a rigid insulation material and having two straight and parallel edge surfaces, and outer and inner surfaces; and a metal frame, comprising a pair of sub-frames, a first sub-frame attached to a first edge surface of the insulation panel and a second sub-frame attached to a second edge surface of the insulation panel, each sub-frame extending along the length of the insulation panel, the length of each sub-frame having a cross-section comprising:

an attaching arm extending along the corresponding edge surface;

an intruding section arranged in the attaching arm and in an angle respect to that, the intruding section intruding into the insulation element; and a box-type structure arranged distally from the intruding section and comprising walls and corners constituting a closed or partly open construction, the box-type structure extending from the attaching arm and being arranged on the outer surface or on the inner surface of the insulation panel; and the building system further comprising a connecting element, being at least essentially as long as the sub-frames and having a cross-section comprising two arms and a connecting section connecting said two arms, the cross-section having a shape of an U-profile, the connecting element, in use, being arranged on said sub-frames of two adjacent elements of said plurality of prefabricated elements, said arms being situated on opposite sides of two of the sub-frames of the two adjacent elements and keeping together said sub-frames of the two adjacent elements.

2. The arrangement as claimed in claim 1, wherein the insulation panel is a thermal insulating board.

3. The arrangement as claimed in claim 1, wherein the connecting element consists of one connecting-component the length of which is at least essentially equal to the length of the insulation panel.

4. The arrangement as claimed in claim 1, wherein the length of the sub-frames has a cross-section comprising the attaching arm, the intruding section, and the box-type structure.

5. The arrangement as claimed in claim 1, wherein the attaching arm comprises at least one bend when seen from an end thereof, and the second edge surface of the insulation panel respective shapes adapted to the shape of the attaching arm.

6. The arrangement as claimed in claim 1, wherein the intruding section is arranged at a distal end of the attaching arm.

7. The arrangement as claimed in claim 1, wherein a cross-section of the box-type structure is a closed structure.

8. The arrangement as claimed in claim 1, wherein the box-type structure comprises at least three corners when seeing from an end thereof.

9. The arrangement as claimed in claim 1, wherein the connecting element consists of one connecting-component the length of which is at least essentially equal to the height of the sub-frames.

10. The arrangement as claimed in claim 1, wherein the cross-section of the box-type structure comprises a first projecting section extending sideways in direction of the inner and outer surfaces of the insulation panel and arranged at a distance from said inner and outer surfaces of the insulation panel, the first projecting section being directed away from the edge surface of the insulation panel wherefrom the attaching arm is extending, and the connecting element comprises a second projecting section that, in use, is arranged to fit in the shape of the projecting sections of the sub-frames of the two adjacent elements of said plurality of prefabricated elements, thus making a locking system between said two sub-frames of the two adjacent elements.

11. The arrangement as claimed in claim 1, wherein the sub-frames are attached to the insulation panel by a glue layer.

12. The arrangement as claimed in claim 1, wherein the sub-frames of the two adjacent elements and/or the sub-frames of the two adjacent elements are attached to each other by a glue layer.

13. The arrangement as claimed in claim 1, wherein also fixing elements are arranged to attach the sub-frames and/or the connecting element.

14. The arrangement as claimed in claim 1, wherein, in use, at least one auxiliary profile is attached to one of said plurality of prefabricated elements between said two sub-frames of the two adkacent elements.

15. The arrangement as claimed in claim 2, wherein the thermal insulating board comprises polyisocyanurate (PIR).

16. The arrangement as claimed in claim 2, wherein the thermal insulating board comprises polyurethane (PUR).

17. The arrangement as claimed in claim 2, wherein the thermal insulating board comprises extruded polystyrene (XPS).

18. The arrangement as claimed in claim 1, wherein a cross-section of the box-type structure is a closed structure, the box-type structure being closed by at least one of the following: a glue layer, a welded joint, and a fixing element.

* * * * *